US010012050B2

(12) United States Patent
Beckett et al.

(10) Patent No.: US 10,012,050 B2
(45) **Date of Patent: *Jul. 3, 2018**

(54) POSITIVE LOCATING FEATURE OF OPTIPORT

(71) Applicant: Baker Hughes, a GE company, LLC, Houston, TX (US)

(72) Inventors: Ian Beckett, Houston, TX (US); Luis A. Castro, Spring, TX (US); Christopher W. Thacker, The Woodlands, TX (US); Jason Harper, Cypress, TX (US); Marc Carriere, Calgary (CA); Leigh Thorne, Sylvan Lake (CA); Jeffrey Koch, Calgary (CA); Justin Reyes, Yukon, OK (US); Bradley Collas, Calgary (CA); Cory Casemore, Macoun (CA); David Luft, Calgary (CA); Orest Zolkavich, Beaumont (CA); Derek Robert Brown, Houston, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/698,120

(22) Filed: Sep. 7, 2017

(65) Prior Publication Data

US 2018/0023365 A1 Jan. 25, 2018

Related U.S. Application Data

(62) Division of application No. 14/684,010, filed on Apr. 10, 2015, now Pat. No. 9,828,825.

(51) Int. Cl.

| | |
|---|---|
| ***E21B 23/02*** | (2006.01) |
| ***E21B 33/12*** | (2006.01) |
| ***E21B 47/09*** | (2012.01) |

(52) U.S. Cl.
CPC ..... *E21B 33/12* (2013.01); *E21B 23/02* (2013.01); *E21B 47/09* (2013.01)

(58) Field of Classification Search
CPC ..... E21B 23/02; E21B 23/00; E21B 23/03; E21B 43/17; E21B 43/26; E21B 43/16;
(Continued)

(56) References Cited

U.S. PATENT DOCUMENTS

| | | | |
|---|---|---|---|
| 4,410,040 | A | 10/1983 | Longacre et al. |
| 6,283,218 | B1 | 9/2001 | Collins |

(Continued)

OTHER PUBLICATIONS

Korean Intellectual Property Office; International Searching Authority; International Search Report & Written Opinion; PCT Patent Application No. PCT/US2016/025879; dated Sep. 5, 2016.

(Continued)

*Primary Examiner* — George S Gray
(74) *Attorney, Agent, or Firm* — Parsons Behle & Latimer

(57) ABSTRACT

A system and method for treating a portion of a wellbore that includes a bottom hole assembly (BHA) connected to a work string. The BHA includes a packing element movable between an unset position and a set position and a locator device movable between retracted position and expanded positions. The locator device may be a locator collet. The locator collet may be expanded by a cone movable with respect to the collet. The expanded locator device is configured to engage a profile in a ported tubular within the wellbore. The engagement between the locator device and the profile selectively prevents further movement of the BHA and provides an indication of the location the BHA. The packing element may then be actuated and the wellbore treated through a port in the ported tubular. The BHA may then be moved to a different ported housing to treat another portion of the wellbore.

17 Claims, 7 Drawing Sheets

(58) Field of Classification Search
CPC ..... E21B 43/24; E21B 41/00; E21B 47/09; E21B 34/06; E21B 33/12; E21B 33/13; E21B 33/129
USPC ..... 166/285
See application file for complete search history.

(56) References Cited

U.S. PATENT DOCUMENTS

| | | | |
|---|---|---|---|
| 2004/0216892 | A1 | 11/2004 | Giroux et al. |
| 2007/0284106 | A1 | 12/2007 | Kalman et al. |
| 2008/0179061 | A1 | 7/2008 | Mcafee |
| 2010/0126725 | A1 | 5/2010 | Ravensbergen |
| 2012/0205108 | A1 | 8/2012 | Stang |
| 2012/0325466 | A1 | 12/2012 | Themig |

OTHER PUBLICATIONS

US Patent and Trademark Office; Office Action ; U.S. Appl. No. 14/384,010; dated Jul. 5, 2017.

POSITIVE LOCATING FEATURE OF OPTIPORT

RELATED APPLICATIONS

The present disclosure is a divisional patent application of U.S. patent application Ser. No. 14/684,010, entitled Positive Locating Feature of Optiport filed on Apr. 10, 2015, which is incorporated by reference herein in its entirety.

FIELD OF THE DISCLOSURE

The embodiments described herein relate to an apparatus, system, and method of using a bottom hole assembly (BHA) having a locator device that may be used to treat a portion of a wellbore.

BACKGROUND

Description of the Related Art

Oil and gas well completions are commonly performed after drilling hydrocarbon producing wellholes. Part of the completion process includes running a well casing assembly into the well. After the casing is set in the well hole, perforating and fracturing operations can be carried out. Generally, perforating involves forming openings through the well casing and into the formation by commonly known devices such as a perforating gun or a sand jet perforator. Thereafter, the perforated zone may be hydraulically isolated and fracturing operations are performed to increase the size of the initially-formed openings in the formation. Proppant materials may be introduced into the enlarged openings in an effort to prevent the openings from closing.

For multi-zone wells, multiple ported collars in combination with sliding sleeve assemblies have been employed. The sliding sleeves are installed on the inner diameter of the casing and/or sleeves and can be held in place by shear pins. In some designs, the bottom most sleeve is capable of being opened hydraulically by applying a differential pressure to the sleeve assembly. After the casing with ported collars is installed, a fracturing process is performed on the bottom most zone of the well. This process may include hydraulically sliding sleeves in the first zone to open ports and then pumping the fracturing fluid into the formation through the open ports of the first zone. After fracturing the first zone, a ball is dropped down the well. The ball hits the next sleeve up from the first fractured zone in the well and thereby opens ports for fracturing the second zone. After fracturing the second zone, a second ball, which is slightly larger than the first ball, is dropped to open the ports for fracturing the third zone. This process is repeated using incrementally larger balls to open the ports in each consecutively higher zone in the well until all the zones have been fractured. However, because the well diameter is limited in size and the ball sizes are typically increased in one sixteenth inch increments, this process limits the number of fracturing zones in a well before ball sizes run out. In addition, the use of the sliding sleeve assemblies and the packers to set the well casing in this method can be costly. Further, the sliding sleeve assemblies and balls can significantly reduce the inner diameter of the casing, which is often undesirable. After the fracture stimulation treatment is complete, it is often necessary to mill out the balls and ball seats from the casing Other solutions are known to permit the selective treatment of portions of a wellbore through ported casing that do not require the reduction of well diameter. For example, U.S. Pat. No. 6,613,321 entitled Bottom Hole Assembly With Ported Completion and Methods of Fracturing Therewith, U.S. Pat. No. 8,695,716 entitled Multi-Zone Fracturing Completion, and U.S. Pat. No. 8,944,167 entitled Multi-Zone Fracturing Completion, each incorporated by reference herein in their entireties, disclose ported casing collars that may be selectively opened by a pressure differential and/or mechanical force. These patents disclose locating a bottom hole assembly (BHA) within the ported casing collar. The location of the BHA permits the application of a pressure differential and/or mechanical force to selectively open the ported collar. A casing collar locator (CCL) is used to position the BHA at the proper location with the casing string. The CCL is used to correlate depth shown in the work string, such as coiled tubing, to the actual depth of the BHA. The CCL provides a small over-pull of weight at the surface as it engages a profile on the collar to indicate the location of the BHA. In certain applications this over-pull weight can sometime be far from definite and the operator may pull the CCL through the collar without realizing an indication was received at the surface. Contact between the casing string and the work string and/or BHA may also provide over-pull weight indicators that are incorrectly identified at the surface as the engagement of the CCL with a collar leading to potential doubt in the confidence of the actual location of the BHA.

SUMMARY

The present disclosure is directed to a BHA having a locator device, which may be a locator collet, and method that overcomes some of the problems and disadvantages discussed above.

One embodiment of the present disclosure is a method of treating a portion of a wellbore. The method comprising running a BHA into a wellbore, the BHA comprising a one or more packing elements in an unset position and a locator collet in a retracted position. The method comprises moving the locator collet to an expanded position and moving the BHA within the wellbore to a first ported tubular. The method comprises engaging a profile on the first ported tubular within the wellbore with the locator collet in the expanded position, wherein the engagement of the profile within the locator collet prevents movement of the BHA. The method comprises setting the one or more packing elements and moving the locator collet to the retracted position. The method comprises treating a portion of the wellbore through the first ported tubular and unsetting the one or more packing elements.

The method may include moving the BHA away from the first ported tubular and moving the locator collet to the expanded position. The method may include moving the BHA within the wellbore to a second ported tubular and engaging a profile on the second ported tubular within the wellbore with the locator collet in the expanded position. The method may include setting the one or more packing elements and moving the locator to the retracted position. The method may include treating a portion of the wellbore through the second ported tubular and unsetting the one or more packing elements.

The method may include applying a first movement to a work string connected to the BHA to move the locator collet to the expanded position. The first movement to the work string may move a pin in a j-slot track from a first position to a second position. The method may include applying a second movement to the work string connected to the BHA to set the one or more packing elements against the first ported tubular and to move the locator collet to the retracted position. The second movement of the work string may move the pin from the second position to a third position. The method may include applying a third movement to the work string after treating the portion of the wellbore to unset the one or more packing elements. The third movement to the work string may move the pin from the third position to a fourth position. The method may include applying a fourth movement to the work string after unsetting the one or more packing elements, the fourth movement may move the pin from the fourth position to the first position. The first movement may apply tension, the second movement may apply compression, the third movement may apply tension, and the fourth movement may apply compression. Treating the wellbore may include hydraulic fracturing, stimulation, tracer injection, cleaning, acidizing, steam injection, water flooding, and/or cementing.

Another embodiment of the present disclosure is a BHA that comprises one or more packing elements, the one or more packing element is movable between a retracted unset position and an expanded position. The BHA comprises a locator device movable between a retracted position and an expanded position and a member movable relative to the locator device, wherein the member moves the locator device to the expanded position. The BHA includes a plurality of slips and drag blocks positioned between the one or more packing elements and the locator device.

The locator device may comprise a locator collet. The member may comprise a cone on a mandrel. The cone may be connected to the mandrel by a plurality of shearable devices. The cone may include a plurality of grooves on an exterior surface. A first force applied to the BHA may move the cone relative to the locator collet to move the locator collet to the expanded position. A second force applied to the BHA after the application of the first force may move the one or more packing elements to the expanded set position and may move the cone from the locator collet to move the locator collet to the retracted position. A third force applied to the BHA after the application of the second force may move the one or more packing elements to the retracted unset position. A fourth force applied to the BHA after the application of the third force may place the BHA in a run in hole configuration. A fifth force applied to the BHA in the run in hole configuration may move the cone relative to the locator collet and may move the locator collet to the expanded position. The first, third, and fifth forces applied to the BHA may comprise tension and the second and fourth forces applied to the BHA may comprise compression.

The BHA may comprise a j-slot track having a first position, a second position, a third position, and a fourth position along the j-slot track. When a pin is located in the first position the locator collet may be retracted and the one or more packing elements may be in the retracted unset position. When the pin is located in the second position the locator collet may be expanded and the one or more packing elements may be in the retracted unset position. When the pin is in the third position the locator collet may be retracted and the one or more packing elements may be in the expanded set position. When the pin is in the fourth position the locator collet may be retracted and the one or more packing elements may be in the retracted unset position. Tension may be applied to the BHA to move the pin from the first position to the second position, compression may be applied to the BHA to move the pin from the second position to the third position, tension may be applied to the BHA to move the pin from the third position to the fourth position, and compression may be applied to the BHA to move the pin from the fourth position to the first position.

Another embodiment of the disclosure may be a system for treating a portion of a wellbore comprising a work string and a BHA connected to the work string. The BHA comprises one or more packing elements movable between a retracted unset position and an expanded set position and a locator collet movable between a retracted position and an expanded position. The system comprises a ported tubular, wherein an opening in the ported tubular may be selectively opened to permit the treatment of a portion of a wellbore, wherein the ported tubular includes a profile configured to engage the locator collet in the expanded position.

The engagement of the locator collet with the profile may selectively prevent movement of the BHA. The system may include a cone connected to a mandrel movable relative to the locator collet, wherein the cone moves the locator collet to the expanded position. The cone maybe shearably connected to the mandrel and the application of a predetermined force may shear the connection of the cone to the mandrel to permit the cone to move along the mandrel. The BHA may comprises a j-slot track, the rotation of the j-slot tract may move the locator collet between the retracted position and the expanded position and the rotation of the j-slot tract may move the one or more packing elements between the retracted unset position and the expanded set position.

Figure 1:
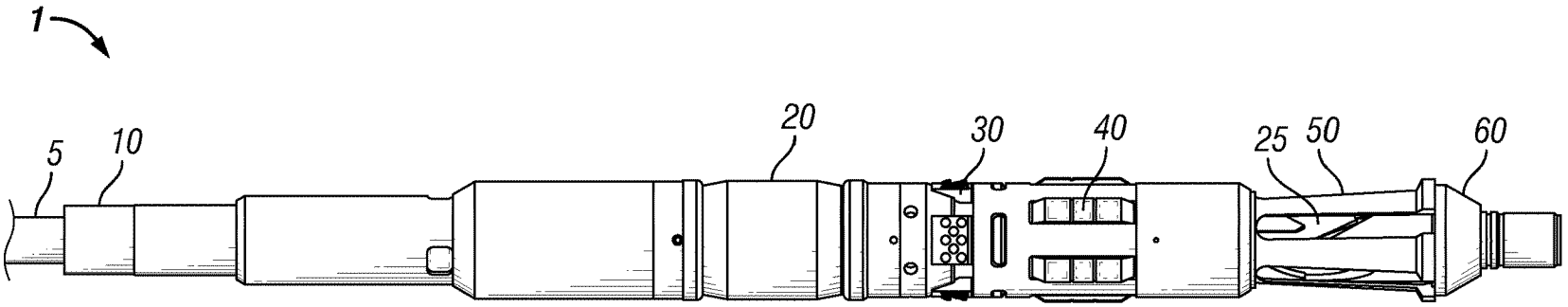
FIG. 1 shows an embodiment of a BHA with a locator collet.

While the disclosure is susceptible to various modifications and alternative forms, specific embodiments have been shown by way of example in the drawings and will be described in detail herein. However, it should be understood that the disclosure is not intended to be limited to the particular forms disclosed. Rather, the intention is to cover all modifications, equivalents and alternatives falling within the scope of the invention as defined by the appended claims.

DETAILED DESCRIPTION

FIG. 1 shows an embodiment of a BHA 1 that includes a locator device 50 that is configured to selectively engage a profile 210 (shown in FIG. 3) on a ported tubular 200 (shown in FIGS. 2-3) to prevent movement of the BHA 1 past the profile 210 on the ported tubular 200 as described herein. The locator device 50 may be various devices configured to selectively engage the profile 210 on the ported tubular 200 as would be appreciated by one of ordinary skill in the art having the benefit of this disclosure. For example, the locator device 50 may be a locator collet as shown in FIG. 1 and will be referred to hereinafter as locator collet 50. As shown in FIG. 1, the BHA 1 may be connected to a work string 5 via a connector 10. The work string 5 is used to convey the BHA 1 into and out of a wellbore. Various work strings 5 may connected to the work string 5 as would be appreciated by one or ordinary skill in the art having the benefit of this disclosure. The work string 5 is only shown for illustrative purposes and, thus is not included in each figure depicting an embodiment of a BHA 1 and 100.

The BHA 1 includes a locator collet 50 that is configured to selectively engage a profile 210 of a ported tubular 200. The collet 50 may include an engaging profile 55 (shown in FIG. 3) that engages the profile 210 of the ported tubular 200. The BHA 1 may include a collet support 60 connected to a mandrel 25 that may be configured to move with respect to the collet 50 to actuate the collet 50 between a retracted position and an expanded position as described herein. The BHA 1 may include a plurality of slips 30 and drag blocks 40 used to retain the BHA 1 at a desired location within a ported casing, tubular, and/or casing collar 200 (herein after referred to as a ported tubular) within a wellbore. Various slip 30 and drag block 40 configurations may be used to selectively retain the BHA 1 at a desired location as would be appreciated by one of ordinary skill in the art having the benefit of this disclosure. The BHA 1 includes a packing element 20 that may be selectively actuated to create a seal against a ported tubular 200 within a wellbore. The packing element 20 may comprise one or more packing elements and a single packing element could be comprised of multiple sealing elements as would be appreciated by one of ordinary skill in the art having the benefit of this disclosure.

The BHA 1 may be run into a wellbore in a first configuration with the packing element 20 and locator collet 50 in retracted configurations. The BHA 1 may then be moved to a second configuration that includes the collet 50 in an expanded position with the packing element 20 in an unset or retracted configuration. The BHA 1 may then be moved to a third configuration in which the packing element 20 is set against the ported tubular 200. While in the third configuration a portion of the wellbore may be treated through a port 220 (shown in FIG. 8) in the ported tubular 200. The treatment of the wellbore through the port 220 may be various treatments as would be appreciated by one of ordinary skill in the art. For example, the treatment may be, but is not limited to, hydraulic fracturing, stimulation, tracer injection, cleaning, acidizing, steam injection, water flooding, or cementing. The port 220 may be selectively opened by the application of a pressure differential and/or mechanical force as would be appreciated by one of ordinary skill in the art having the benefit of this disclosure. In the third configuration, the slips 30 and drag blocks 40 may engage the ported tubular 200 to prevent undesired movement of the BHA 1. Further, the locator collet 50 may be moved to the retracted position in the third configuration. The BHA 1 may then be moved to a fourth configuration in which the locator collet 50 and packing element 20 are both in the retracted positions. Likewise, the slips 30 will be moved to retracted positions. The BHA 1 may then be moved from the fourth configuration to the first configuration to repeat the progression for multiple treatments, if desired.

Figure 10:
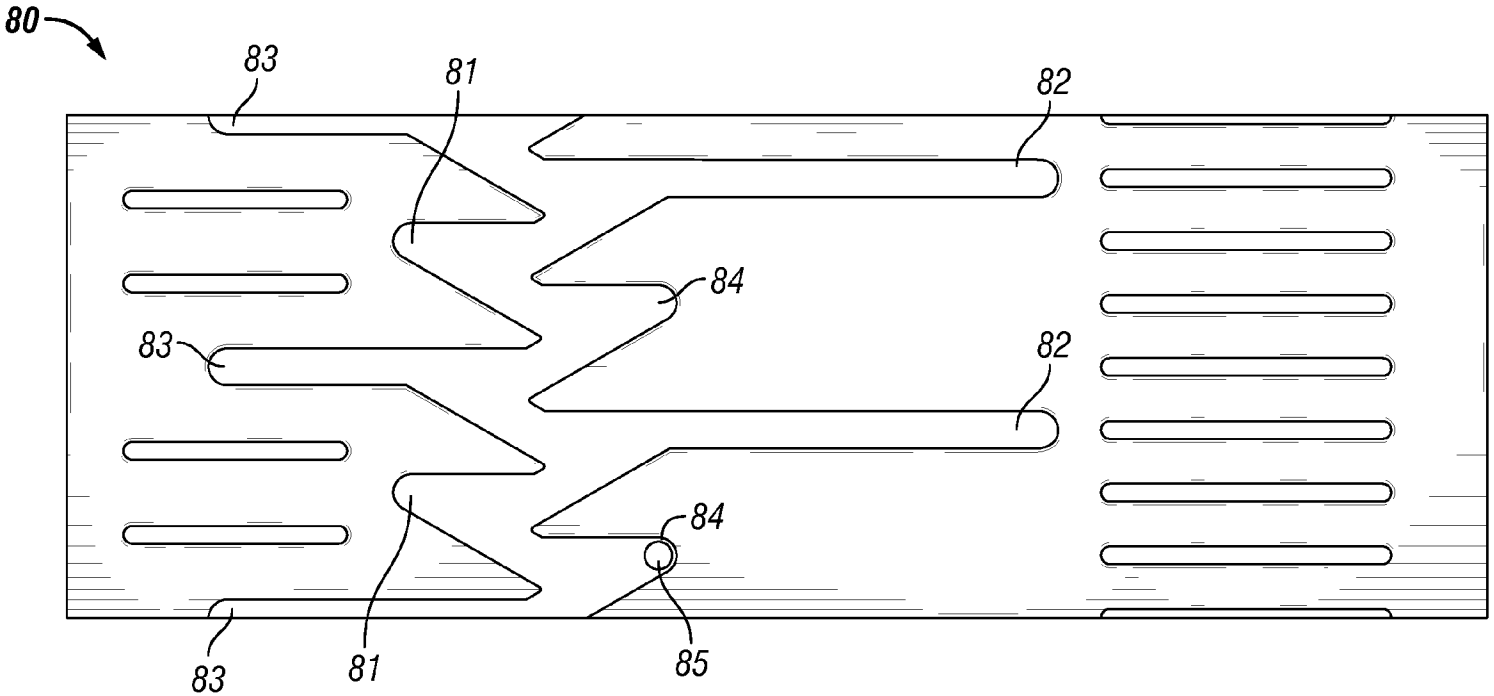
FIG. 10 shows a schematic of an embodiment of a continuous j-slot track for a BHA having a locator collet.

The BHA 1 may be moved between configurations by the application of tension or compression to the BHA 1 via a work string 5 as described herein. For example, the BHA 1 may include a continuous j-slot track 80 as shown in FIG. 10. The application of tension and compression via the work string 5 may advance a pin 85 along various positions of the continuous j-slot track 80 as described herein and as would be appreciated by one of ordinary skill in the art having the benefit of this disclosure. Each position along the j-slot track 80 may correspond to a configuration of the BHA 1 as described herein. In another embodiment, the BHA 1 may be moved between configurations by the application of differential pressure through the work string 5, the annulus between the work string 5 and the casing, or a combination of both.

Figure 2:
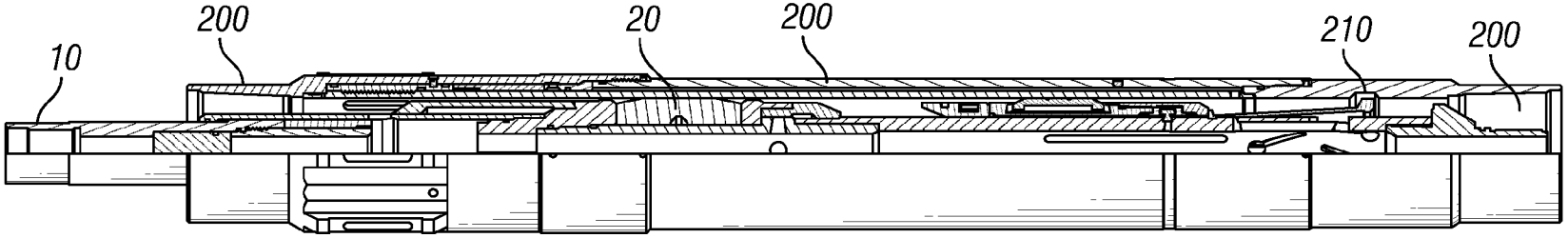
FIG. 2 shows the BHA of FIG. 1 positioned within a ported tubular.
Figure 3:
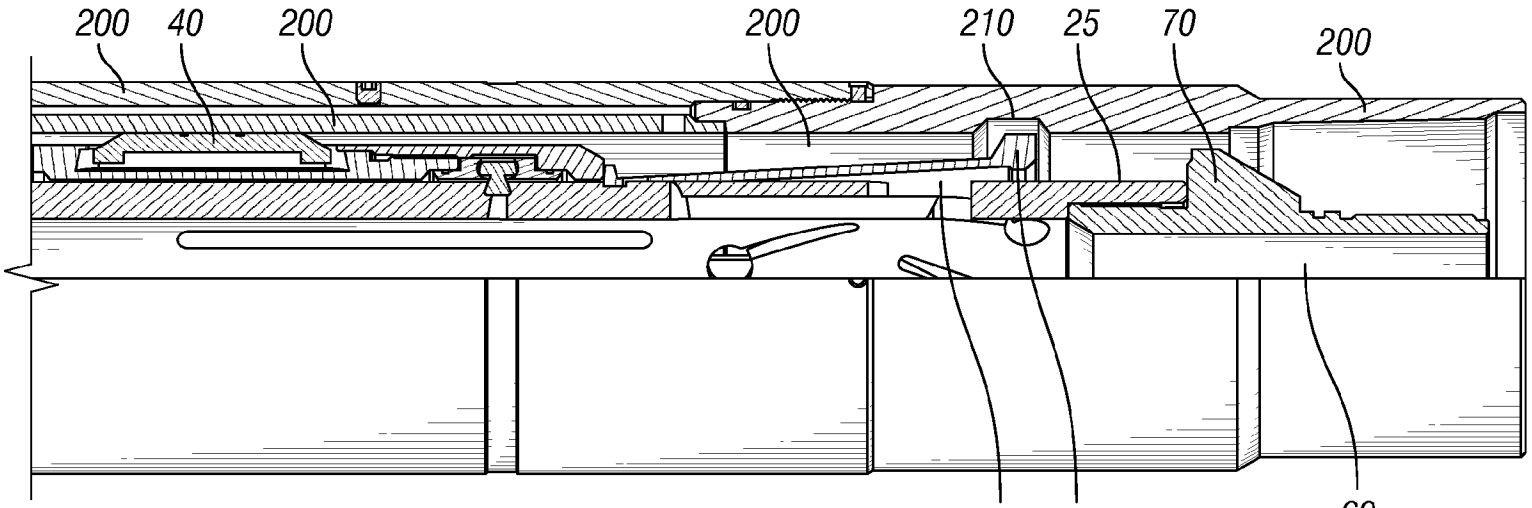
FIG. 3 shows a close-up view of the locator collet of FIG. 2 positioned adjacent to a profile in the ported tubular.

FIG. 2 shows a BHA 1 positioned with a ported tubular 200. Although not depicted in FIG. 2, the ported tubular 200 may be positioned at a location along a string of tubing, or casing, positioned within a wellbore as would be appreciated by one of ordinary skill in the art having the benefit of this disclosure. Such a string of casing or tubing is shown in the patents previously incorporated by referenced herein. FIG. 2 shows the collet 50 positioned adjacent to a profile 210 in the ported tubular 200. FIG. 3 shows a close-up view of the BHA 1 within the ported tubular 200. The collet support 60 includes a member 70 that may be moved against the collet 50 to move a portion 55 of the collet 50 into selective engagement with the profile 210 of the ported tubular 200. The mandrel 25 of the BHA 1 may be used to move the member 70 to expand the portion 55 of the collet 50 into the profile 210. Movement of the BHA 1 with respect to the ported tubular 200 will be prevented while the collet 50 is selectively engaged with the profile 210. The profile 210 and collet 50 may be configured to prevent upward movement, downward movement, or both while engaged as would be appreciated by one of ordinary skill in the art having the benefit of this disclosure.

Figure 4:
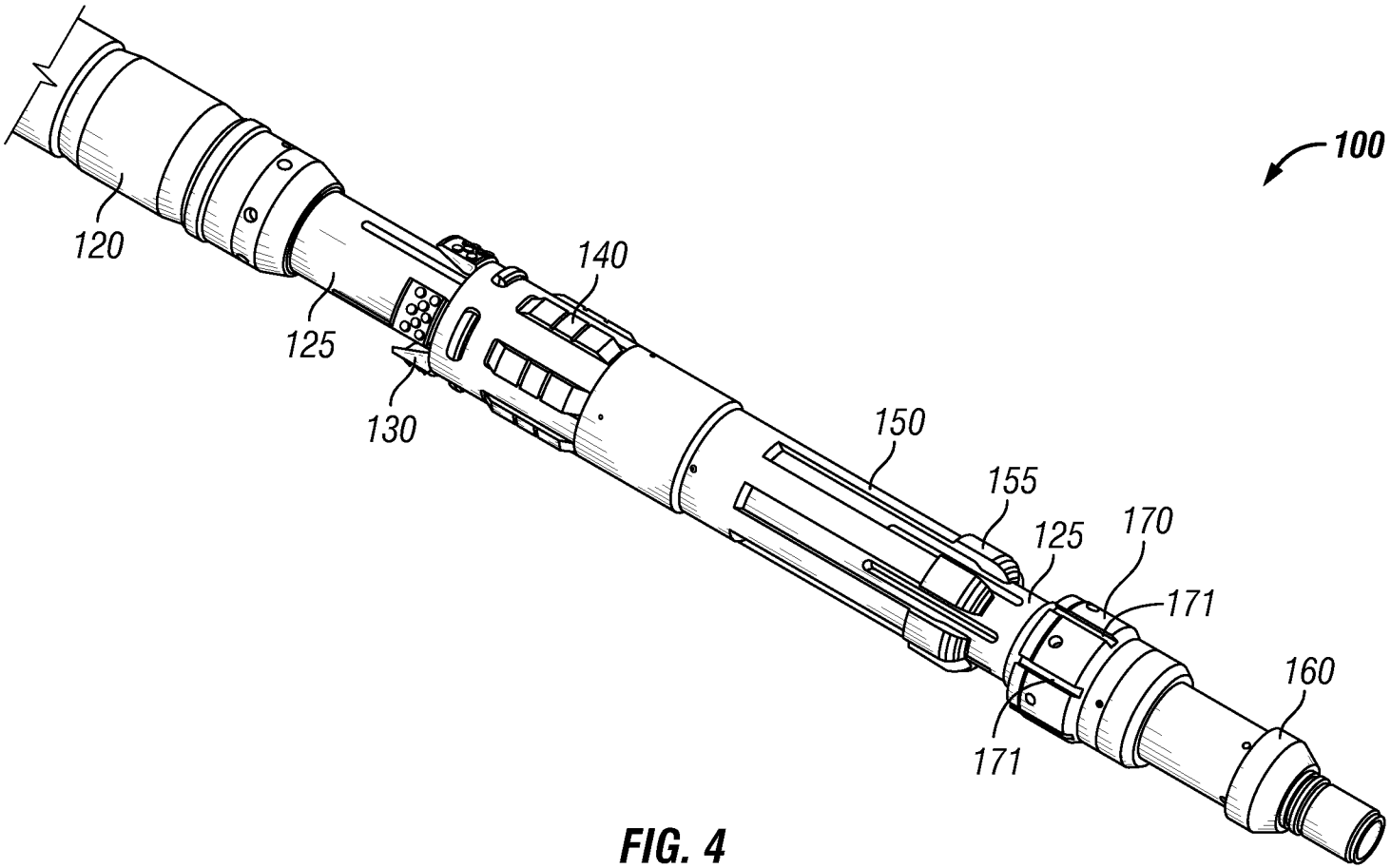
FIG. 4 shows an embodiment of a BHA with a locator collet.

FIG. 4 shows a perspective view of an embodiment of a BHA 100. The BHA 100 includes a packing element 120, mandrel 125, slips 130, drag blocks 140, locator device 150 (herein after referred to as locator collet), collet support 160, and cone 170. The movement of the mandrel 125 may be used to actuate the packing element 120, slips 130, and locator collet 150 between retracted (unset) and expanded (set) positions as described herein. The cone 170 may include grooves or channels 171 that permit the movement of solids and/or debris past the cone 170 to reduce the chance that the BHA 100 becomes stuck within the casing string.

Figure 5:
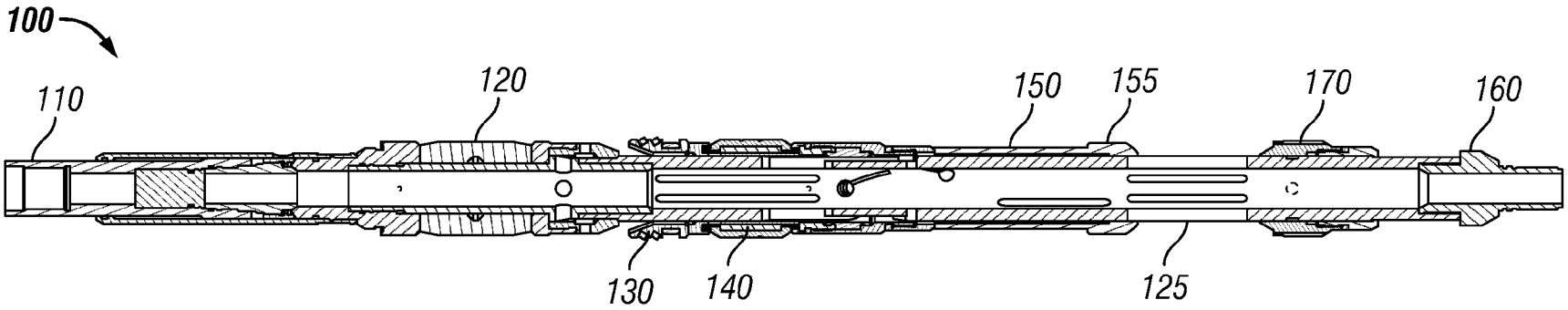
FIG. 5 shows a run in hole configuration of the BHA of FIG. 4.

FIG. 5 shows the BHA 100 in a first, or run in, configuration. In the first configuration, the packing element 120 is in an unset or retracted position as are the slips 130 and collet 150. This permits the BHA 100 to be moved within a tubing string or a casing string to a desired location within the wellbore. For example, the BHA 100 may be positioned below the location of the ported tubular 200 along the string. Once at the desired location, work string 5 movement may be applied to the BHA 100 via a work string 5 to apply a first force, such as tension, on the BHA 100 to move the BHA 100 to a second configuration.

Figure 6:
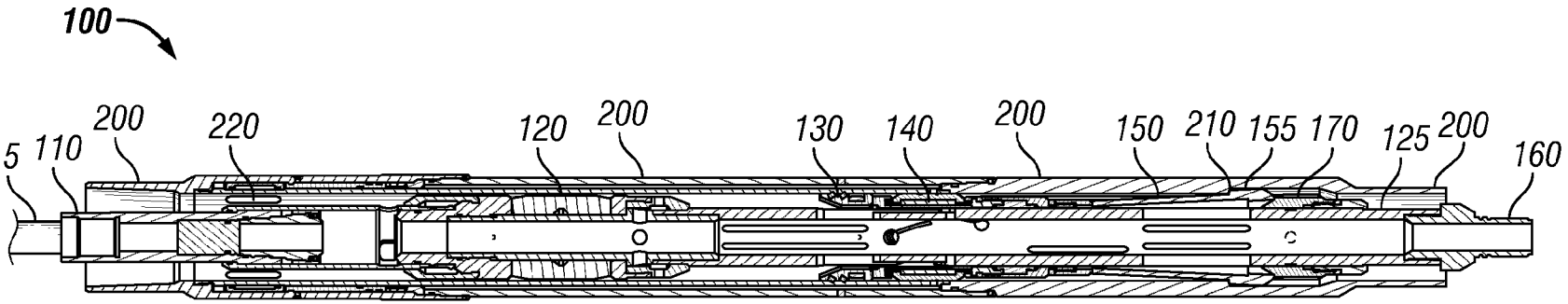
FIG. 6 shows the BHA of FIG. 4 connected to a work string with the locator collet expanded and engaged with a profile on a ported tubular.

FIG. 6 shows the BHA 100 in the second configuration. In the second configuration, the applied tension moves the mandrel 125 upward until the cone 170 is positioned between the collet 150 and the mandrel 125. The cone 170 is configured to move a portion 155 of the collet 150 outward away from the mandrel 125. The collet 150 may comprise a plurality of fingers as shown in FIG. 4 and FIG. 7.

Figure 7:
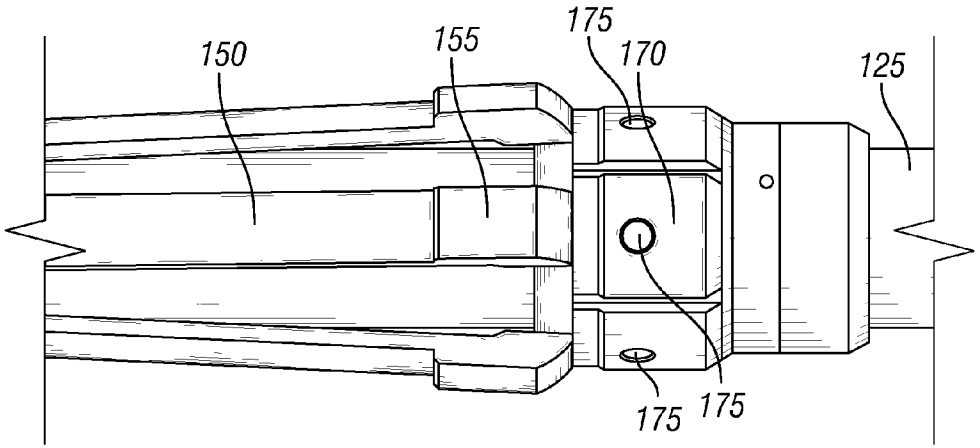
FIG. 7 shows a close up view of an embodiment of a locator collet and cone.

FIG. 7 shows a close up view of an embodiment of a cone 170 engaging an embodiment of a locator collet 150 to force at least a portion 155 of the collet outward from the mandrel 125. The cone 170 may include a plurality of grooves or channels 171 around its perimeter. The channels 171 may permit the passage of debris and/or solids past the cone 170 to reduce the chance that the BHA 100 will become stuck within the wellbore. The cone 170 may be connected to the mandrel 125 via shearable devices 175 that permits the emergency release of the cone 170, if necessary. For example, an upward force may be applied via the work string 5 to shear the shearable devices to release the cone 170 and permit the downward movement of the cone 170 along the mandrel 125 until it reaches the collet support 160 connected to the mandrel 125. This may be necessary if the operator is unable to move the locator collet 150 from the expanded position to the retracted position under normal procedures. The downward movement of the cone 170 along the mandrel 125 will permit the portion 155 of the locator collet 150 to disengage from the profile 210 of the ported tubular 200, which will permit the BHA 100 to once again move within the casing or tubing string. The shearable devices 175 may vary in size, number, and location and may be configured to shear at a predetermined application of force as would be appreciated by one of ordinary skill in the art having the benefit of this disclosure.

Once the locator collet 150 is moved to the expanded position, the BHA 100 may then be moved upwards, or downwards, until the portion 155 of the collet 150 engages a profile 210 of a ported tubular 200. The engagement of the portion 155 of the collet 150 with the profile 210 prevents further movement of the BHA 100 until the portion 155 is selectively disengaged with the profile 210. This selective engagement between the locator collet 150 and the ported tubular 200 provides a clear indicator to the operator of the BHA 100 of the location of the BHA 100 within the string in the wellbore. The location will be a desired location within the wellbore to be treated. For example, the wellbore may be fractured and/or stimulated by various methods as would be appreciated by one of ordinary skill in the art having the benefit of this disclosure. Work string 5 movement may then be applied to the BHA 100 to apply a second force, such as compression, on the BHA 100 to move the BHA 100 to a third configuration.

Figure 8:
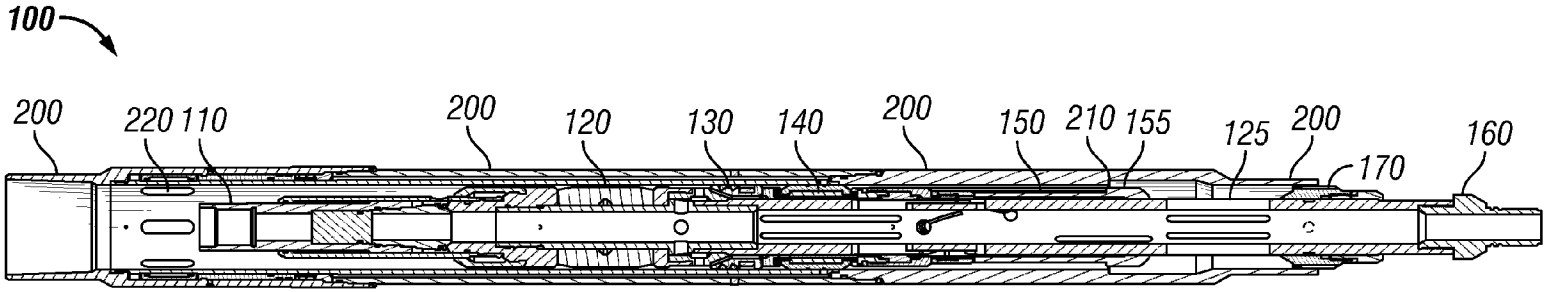
FIG. 8 shows the BHA of FIG. 4 in a treatment configuration.

FIG. 8 shows the third configuration of the BHA 100. In the third configuration, the packing element 120 is set against the ported tubular 200. Likewise, the slips 130 and drag blocks 140 are set against the ported tubular 200 to selectively prevent movement of the BHA 100 within the casing or tubing string. The mandrel 125 has been moved downward to move the cone 170 away from the collet 150. The collet 150 retracts to its initial position and the portion 155 of the collet 150 no longer engages with the profile 210 of the ported tubular 200. However, the slips 130, drag blocks 140, and/or packing element 120 selectively prevent movement of the BHA 100 within the ported tubular 200. A portion of the wellbore may be treated through a port or ports 220 in the ported tubular 200 while the BHA 100 is in the third configuration. The port 220 may be selectively opened by various mechanisms. For example, a pressure differential and/or mechanical movement may be used to selectively open the port 220 as disclosed in the patents incorporated by referenced herein. After the wellbore has been treated, work string 5 movement may be applied to the BHA 100 to apply a third force, such as tension, to move to a fourth configuration.

Figure 9:
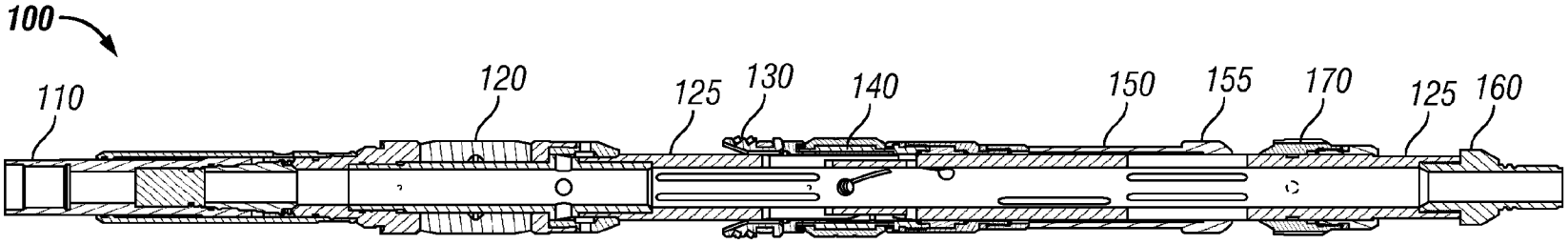
FIG. 9 shows the BHA of FIG. 4 in a pull out of hole configuration.

FIG. 9 shows the BHA 100 in a fourth configuration. The packing element 120, slips 130, and collet 150 will all be in their respective retracted positions permitting the BHA 100 to be moved within the casing or tubing string. Thus, the BHA 100 may be moved to a second location along the string that includes a ported tubular adjacent to a portion of the wellbore to be treated. Work string 5 movement may be applied to the BHA 100 via the work string 5 to apply a fourth force, such as compression, to move the BHA 100 from the fourth configuration to the first configuration. The BHA 100 may then be located adjacent the next ported tubular 200 and may be moved through the second, third, and fourth configurations to locate the ported tubular, treat the wellbore, and release from the ported tubular 200, as discussed above.

As discussed above, a continuous j-slot track may be used to move the BHA 1 and 100 between configurations. FIG. 10 shows a schematic of one embodiment of a continuous j-slot track 80. The continuous j-slot track 80 includes a first position 81, a second position 82, a third position 83, and a fourth position 84. The continuous j-slot track 80 may include only four positions around its path or may include multiple sets of these four positions repeated around its path as would be appreciated by one of ordinary skill in the art having the benefit of this disclosure. The mandrel 25 and 125 of the BHA 1 and 100 moves along the BHA 1 and 100 changing between configurations as the pin 85 traverses along the continuous j-slot track 80 due to the application of tension or compression on the BHA 1 and 100 via the work string 5, as described herein.

FIG. 10 shows the pin 85 in the fourth position 84, which would put the BHA 100 in the fourth or pull out of hole configuration. The fourth configuration is depicted in FIG. 9 with regards to the BHA 100 of FIG. 4. In the fourth configuration, the expandable elements of the BHA 100 are all in their respective retracted positions permitting the BHA 100 to be moved within a casing string. Compression may be applied to the BHA 100 via the tubing string 5 to move the pin 85 from the fourth location 84 to the first location 81. With the pin 85 in the first location 81 along the continuous j-slot track 80, the BHA 100 is in the first or run in hole configuration which also has all of the expandable elements in their respective retracted positions.

Tension may then be applied to the BHA 100 via the tubing string 5 to move the pin 85 from the first location 81 to the second location 82. The tension moves the mandrel 125 upward moving the cone 170 to engage the collet 150 and expand at least a portion 155 outward away from the mandrel 125. The BHA 100 may then be pulled up the casing string until the portion 155 engages a corresponding profile 210 on a ported tubular 200. Such an engagement will prevent further upward movement of the BHA 100 and provide a positive indicator to the operator concerning the location of the BHA 100.

Compression may then be applied to the BHA 100 via the tubing string 5 to move the pin 85 from the second location 82 to the third location 83. This moves the mandrel 125 downward moving the cone 170 away from the collet 150 permitting the collet 150 to release from the profile 210 of the ported tubular 200. The downward movement of the mandrel 125 also sets the packing element 120, slips 130, and drag blocks 140 against the ported tubular 200. The wellbore may then be treated through a port or ports 220 in the ported tubular 200 as previously discussed.

Tension may then be applied to the BHA 100 via the tubing string 5 to move the pin 85 from the third location 83 to the fourth location 84 unsetting the packing element 120, slips 130, and drag blocks 140 from the ported tubular 200. The BHA 100 may then be moved to the next ported tubular 200 with the process repeated to treat the wellbore at that location. The number or order of work string 5 movements described above to apply a force on the BHA 100 and move the BHA 100 between configurations may be varied as would be appreciated by one of ordinary skill in the art having the benefit of this disclosure.

Figure 11:
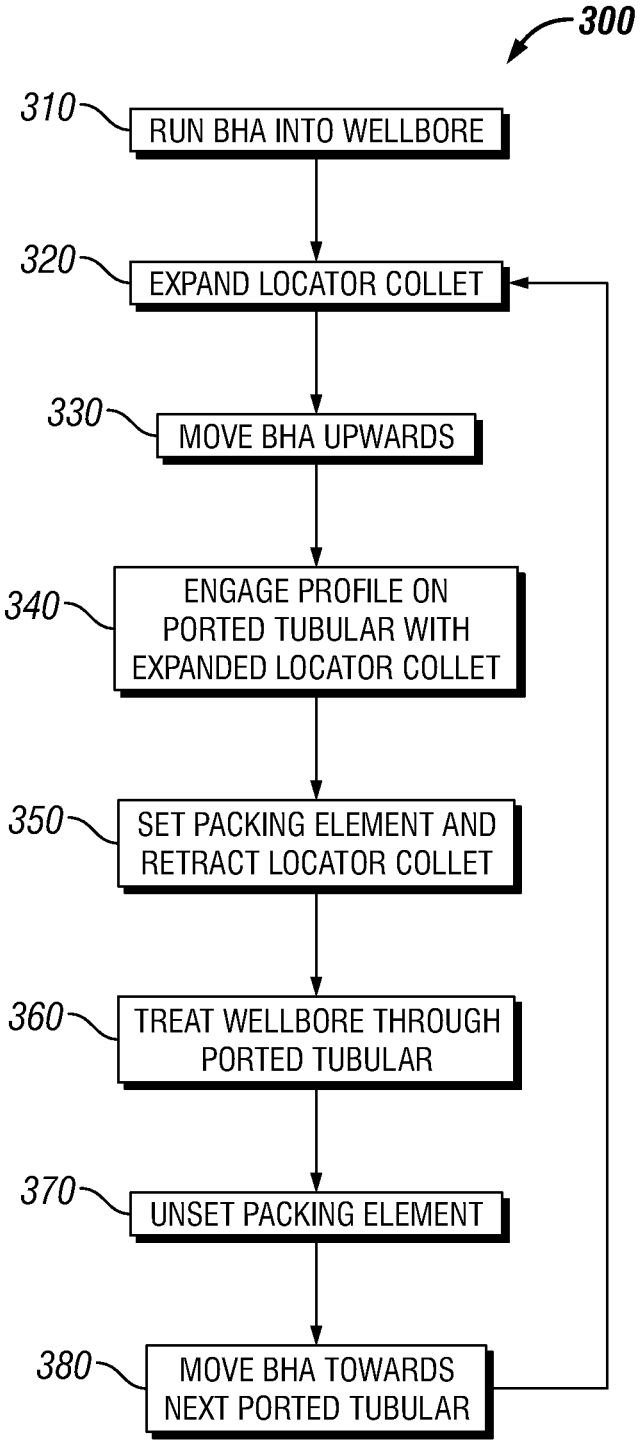
FIG. 11 shows a flow chart of an embodiment of a method of treating a portion of a wellbore.

FIG. 11 shows a flow chart depicting one method 300 for treating a wellbore. A BHA 1 or 100 is run into a wellbore in step 310. The BHA 1 and 100 is run into a casing or tubing string having ported tubular 200 that permits the selective treatment of the wellbore. After positioning the BHA 1 and 100 at a particular location, a locator collet 50 and 150 is expanded at step 320 and the BHA 1 and 100 is moved upwards in step 330 until a profile 210 on the ported tubular 200 is engaged by the expanded locator collet 50 and 150 at step 340. A packing element is expanded and the locator collet is retracted at step 350. The wellbore is treated through the ported tubular at step 360. The packing element is unset at step 370 and the BHA 1 and 100 is moved towards the next ported tubular 200 at step 380. The method steps 320-380 may be repeated to treat the wellbore and move to yet another location.

Although this disclosure has been described in terms of certain preferred embodiments, other embodiments that are apparent to those of ordinary skill in the art, including embodiments that do not provide all of the features and advantages set forth herein, are also within the scope of this disclosure. Accordingly, the scope of the present disclosure is defined only by reference to the appended claims and equivalents thereof.

What is claimed is:

1. A bottom hole assembly (BHA) comprising:

one or more packing elements, the one or more packing elements movable between a retracted unset position and an expanded set position;

a locator device movable between a retracted position and an expanded position, wherein the locator device is movable from the expanded position to the retracted position while the one or more packing elements remain in the expanded set position;

a member moveable relative to the locator device, wherein the member moves the locator device to the expanded position;

a plurality of slips positioned between the one or more packing elements and the locator device; and a plurality of drag blocks positioned between the one or more packing elements and the locator device.

2. The BHA of claim 1, wherein the locator device comprises a locator collet.

3. The BHA of claim 2, wherein the member further comprises a cone on a mandrel.

4. The BHA of claim 3, wherein the cone is connected to the mandrel by a plurality of shearable devices.

5. The BHA of claim 4, wherein the cone includes a plurality of grooves on an exterior surface.

6. The BHA of claim 5, wherein a first force applied to the BHA moves the cone relative to the locator collet to move the locator collet to the expanded position.

7. The BHA of claim 6, wherein a second force applied to the BHA after the application of the first force moves the one or more packing elements to the expanded set position and moves the cone from the locator collet to move the locator collet to the retracted position.

8. The BHA of claim 7, wherein a third force applied to the BHA after the application of the second force moves the one or more packing elements to the retracted unset position.

9. The BHA of claim 8, wherein a fourth force applied to the BHA after the application of the third force to move the one or more packing elements to the retracted unset position places the BHA in a run in hole configuration.

10. The BHA of claim 9, wherein the application of a fifth force to the BHA when in the run in hole configuration moves the cone relative to the locator collet to move the locator collet to the expanded position.

11. The BHA of claim 10, wherein the first, third, and fifth forces comprise tension and the second and fourth forces comprise compression.

12. The BHA of claim 11, further comprising a j-slot track having a first position, a second position, a third position, and a fourth position along the j-slot track.

13. The BHA of claim 12, wherein when a pin is located in the first position the locator collet is retracted and the one or more packing elements is in the retracted unset position.

14. The BHA of claim 13, wherein when the pin is located in the second position the locator collet is expanded and the one or more packing elements is in the retracted unset position.

15. The BHA of claim 14, wherein when the pin is located in the third position the locator collet is retracted and the one or more packing elements is in the expanded set position.

16. The BHA of claim 15, wherein when the pin is located in the fourth position the locator collet is retracted and the one or more packing elements is in the retracted unset position.

17. The BHA of claim 16, wherein tension is applied to the BHA to move the pin from the first position to the second position, wherein compression is applied to the BHA to move the pin from the second position to the third position, wherein tension is applied to the BHA to move the pin from the third position to the fourth position, and wherein compression is applied to the BHA to move the pin from the fourth position to the first position.

* * * * *